US008371203B2

(12) United States Patent
Watson

(10) Patent No.: US 8,371,203 B2
(45) Date of Patent: Feb. 12, 2013

(54) MINE AND EXPLOSIVE CLEARING MACHINE AND IMPLEMENT

(76) Inventor: John E. Watson, Barnesville, OH (US)

( * ) Notice: Subject to any disclaimer, the term of this patent is extended or adjusted under 35 U.S.C. 154(b) by 0 days.

(21) Appl. No.: 13/399,962

(22) Filed: Feb. 17, 2012

(65) Prior Publication Data

US 2012/0240753 A1 Sep. 27, 2012

Related U.S. Application Data

(60) Provisional application No. 61/467,182, filed on Mar. 24, 2011.

(51) Int. Cl.
*F41H 11/20* (2011.01)

(52) U.S. Cl. ..... 89/1.13

(58) Field of Classification Search ..... 89/1.13; 102/402, 403; 172/189, 612, 84, 141; 37/403, 37/404, 408–410, 903
See application file for complete search history.

(56) References Cited

U.S. PATENT DOCUMENTS

| | | | | |
|---|---|---|---|---|
| 2,820,405 | A * | 1/1958 | Puckett | 172/200 |
| 4,050,596 | A * | 9/1977 | Zeuner et al. | 414/686 |
| 4,467,694 | A | 8/1984 | Azulai et al. | |
| 4,552,053 | A | 11/1985 | Bar-Nefy et al. | |
| 4,938,114 | A | 7/1990 | Matthews et al. | |
| 5,189,243 | A | 2/1993 | Hambric | |
| 5,198,608 | A | 3/1993 | Cahill | |
| 5,373,774 | A | 12/1994 | Akbar | |
| 5,626,194 | A * | 5/1997 | White | 169/24 |
| 5,829,536 | A * | 11/1998 | Pigg et al. | 172/482 |
| 5,836,398 | A * | 11/1998 | White | 169/24 |
| 6,330,920 | B1 | 12/2001 | Wanner | |
| 6,892,622 | B2 | 5/2005 | Watson | |
| 2003/0145717 | A1 * | 8/2003 | Yamamoto et al. | 89/1.13 |

FOREIGN PATENT DOCUMENTS

GB 2220894 1/1990

OTHER PUBLICATIONS

Website, http://www.globalsecurity.org/military/systems/ground/d7.htm, "Medium T-9 Dozer (D-7) D7G Mine-Clearing/Armor Protection (MCAP) Bulldozer," two sheets printed from the internet on Feb. 3, 2011.

* cited by examiner

*Primary Examiner* — Michael Carone
*Assistant Examiner* — Reginald Tillman, Jr.
(74) *Attorney, Agent, or Firm* — Richard C. Litman

(57) ABSTRACT

The mine and explosive clearing machine and implement includes a long reach excavator modified with a float-type hydraulic valve for vertical control of the arm. The mine and explosive clearing implement is installed on the distal end of the arm in place of a conventional tool. The implement includes a frame having multiple tilling blades separated by shoes defining blade penetration depth. Multiple cables are pivotally attached to the rear of the frame, each cable having another tilling blade at its distal end and a brush blade opposite the tilling blade. The cables may be inverted to orient either blade downward. The prime mover of the excavator is positioned and the arm extended rearward. The implement is then lowered and dragged forward toward the prime mover so that the blades engage the surface to dislodge and/or detonate explosives at a safe distance from the prime mover.

19 Claims, 7 Drawing Sheets

MINE AND EXPLOSIVE CLEARING MACHINE AND IMPLEMENT

CROSS-REFERENCE TO RELATED APPLICATION

This application claims the benefit of U.S. Provisional Patent Application Ser. No. 61/467,182, filed Mar. 24, 2011.

BACKGROUND OF THE INVENTION

1. Field of the Invention

The present invention relates to the handling of explosive materials, and more particularly, to a mine and explosive clearing machine and implement that includes an implement removably attached to a long reach hydraulic excavator to form the complete machine.

2. Description of the Related Art

Numerous automated and semi-automated machines and devices have been developed in the past for the purpose of clearing, exploding, and/or disarming explosive devices planted in the ground or elsewhere. The purpose of such machines is of course to remove the operator(s) of the machines from harm's way, insofar as possible. The vast majority of encounters with such mines and explosive devices is by the military, and as a result most mine and explosive clearing machines have been developed for attachment to the front of an armored tank or similar military vehicle having sufficient shielding to protect the crew. These devices have been adapted to be pushed by the tank or other vehicle in order that the mine or explosive clearing apparatus would encounter an explosive device before the vehicle, in an attempt to save the vehicle from significant damage.

However, the result of such pusher mechanisms is that the linkage between the tank or other vehicle and the explosive clearing apparatus is relatively short by necessity, in order to provide the required rigidity for the assembly. This has the effect of placing the operating vehicle, and thus its crew, relatively close to the mine and explosive clearing apparatus, thereby placing the vehicle and its crew at considerably greater risk than would be the ease if the clearing machine were positioned at some distance from the vehicle. However, there is no good alternative for this potentially hazardous situation so long as the mine and explosive clearing apparatus is pushed by its operating vehicle.

Nearly all such pusher-type mine and explosive clearing devices incorporate plow-type blades similar to snow plow blades, to push plowed debris forward and to the side of the advancing vehicle behind the machine. A few others utilize a heavy crawler-type tractor (e.g., D-7 Caterpillar Tractor, etc.) with its conventional forwardly disposed blade. All such blades have a wide span and relatively large surface area, with no provision for dissipating the force of the blast from an explosive device. While such blades achieve the desired result of plowing the ground and uncovering (and detonating) most mines encountered and deflecting the resulting blast to some degree, an explosive device of sufficient size can result in severe damage to the blade and its attachment structure due to the large area of the blade receiving a substantial percentage of the blast force. When this occurs, the mine clearing apparatus comprising the blade, its attachment and control structure, and its operating vehicle, is taken out of commission, regardless of the protection provided to the operator or crew.

Another limitation of such vehicles is that they cannot be used extensively for dredging operations to clear a flooded area of mines or explosives. In some instances, mines may have been placed in low-lying areas that subsequently became flooded, and most armored tanks and similar vehicles are limited regarding the depth of water they may negotiate. Also, while their crawler-type tracks generally provide excellent traction, they find their limits in excessive mud and in swampy areas.

Mines and explosive devices are also often placed in urban areas, in narrow streets and alleyways that cannot be negotiated by a relatively wide tank or Caterpillar tractor or the like. These explosive devices are often in the form of smaller anti-personnel mines and explosives that may not do serious damage to a large armored vehicle, but will seriously injure or kill a soldier or other individual who happens to set it off. Many such devices are not buried in the ground due to paving or other difficulties, but may be detonated by a trip wire or the like strung across a narrow pathway between structures. If the area is too narrow for a military tank or the like, a person walking through the area is likely to trip the trip wire and detonate the explosive device before it can be cleared or detonated by a machine.

Thus a mine and explosive clearing machine and implement solving the aforementioned problems is desired.

SUMMARY OF THE INVENTION

The mine and explosive clearing machine and implement includes an implement configured for attachment to the distal end of the arm of a long reach excavator, the combination of the implement and the excavator forming the mine and explosive clearing machine. Such excavators conventionally have an articulating arm of two sections, each section being hydraulically controlled by the operator. The excavator may be equipped with a number of different, interchangeable accessories, e.g., a backhoe-type shovel or bucket. The bucket or other accessory is removed from the distal end of the arm, and the mine and explosive clearing implement is installed in its place on the arm. The excavator is modified by replacing the conventional hydraulic valve for controlling the lifting of the outer or distal component of the arm with a hydraulic valve allowing the distal section of the arm to "float," i.e., to allow the weight of the distal end of the arm and the mine and explosive clearing implement to rest upon the surface without hydraulic system pressure either lifting the arm or forcing it downward against the surface. The excavator, or at least the operator cab, may be further modified with armor plate and/or impact resistant glass or plastic windows to protect the operator therein. A remote camera may be installed toward the distal end of the arm so that the camera transmits a video picture of the area of the implement back to the cab, either by cable along the arm or by wireless signal.

The mine and explosive clearing implement includes a frame having a series of laterally spaced blade attachment flanges extending therefrom, arranged in pairs. An earth cutting or tilling blade is removably installed between the flanges of each pair to depend from the frame. Each of the tilling blades is secured to its flanges by fasteners. The fasteners are arranged with the fasteners in the forward direction of travel of the blades preferably being weaker than the rearmost fasteners. Thus, when the blade encounters a very hard object such as a large rock or chunk of concrete, the forward bolts can break to allow the blade to pivot rearward to pass over the object. The strength difference of the fasteners may be provided by different metallurgy, different fastener or pin diameters, hollow and solid pins, etc.

A shoe assembly comprising a forward portion and a rear portion is installed between each of the blades depending from the frame. The shoes ride over the surface, and serve to limit the downward penetration of the tilling blades into the earth or other material upon which the machine is riding. The shoes are replaceable when required, as are the tiller blades.

A plurality of heavy cables extends from the back of the frame. Each of the cables is pivotally and removably secured to the frame. The distal end of each cable is equipped with a permanently installed fitting having a plurality of brush blades extending from one side thereof. The side diametrically opposite the brush blades has a pair of tilling blade attachment flanges extending therefrom and a tilling blade removably secured thereto. The tilling blades extending from the frame and the tilling blades extending from the distal ends of the cables are identical to one another, and may be interchanged. The cables may be removed from their pinned pivotal attachment to the frame, inverted by 180°, and reattached to position either the brush blades or the tilling blades downwardly.

The mine and explosive clearing implement is installed on the distal end of the arm of a long reach excavator to form the mine and explosive clearing machine, as noted further above. In operation, the prime mover and cab of the excavator is disposed forward of the mine and explosive clearing implement. The operator of the excavator positions the prime mover of the machine at a safe location and extends the arm to position the mine and explosive clearing implement as needed. The arm is then lowered and the tilling blades of the implement forced into the ground as necessary by applying positive hydraulic pressure, as is used when using a bucket or shovel attachment on the arm. The distal end of the arm is then pulled forward toward the prime mover and cab of the excavator, the weight of the distal end of the excavator arm and implement being sufficient to provide sufficient downward force for the tilling blades to remain engaged with the underlying earth. The tilling blades at the distal ends of the cables, or the brush blades, depending upon cable orientation, are also dragged over or through the surface to dislodge and/or detonate any mines or other explosives that might be encountered.

When such a sweep is completed, the distal end of the arm and its implement are still at some distance from the prime mover and its cab. The operator may reposition the prime mover, extend the arm, and begin another sweep from the point of the end of the previous sweep, thereby forming a continuous clear path. The machine is particularly useful in clearing relatively narrow pathways, alleys, and the like in urban areas due to the long reach of the arm of the excavator and the relatively narrow width of the implement in comparison to devices configured for attachment to the front of a military tank or similar vehicle.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The mine and explosive clearing machine and implement includes a specially configured implement attached to the distal end of the arm assembly of a long reach excavator in place of the conventional bucket or other attachment. The excavator is modified by replacing the conventional two-way hydraulic valve controlling the lift of the distal portion of the arm assembly with a valve allowing the distal portion of the arm to "float," i.e., for the distal arm portion to apply force upon the surface solely due to its weight, without hydraulic force being applied to the arm lift mechanism in this valve position. Thus, the implement may be dragged across the surface with its blades penetrating the surface due to the weight of the distal end of the arm and the implement to dislodge and explode any mines or other explosive devices encountered by the implement.

Figure 1:
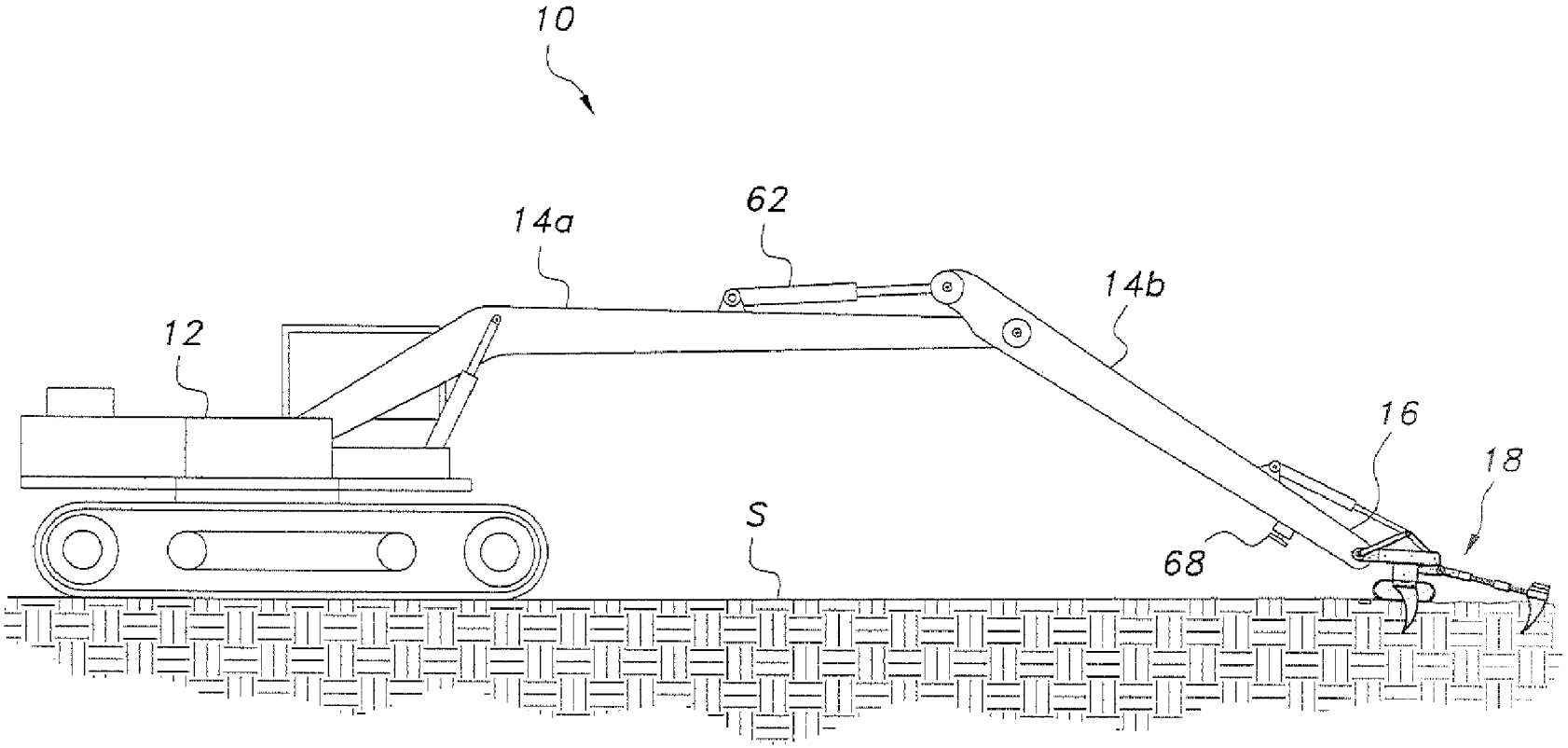
FIG. 1 is an environmental right side elevation view of a mine and explosive clearing machine and implement according to the present invention.

FIG. 1 of the drawings provides a right side elevation view of an exemplary mine and explosive clearing machine and implement, the machine being designated generally as 10. The machine 10 comprises a prime mover 12, preferably in the form of a long reach excavator, as shown in FIG. 1. Such long reach excavators are conventionally equipped with hydraulically powered, selectively controlled articulating arms, which comprise two segments 14*a* and 14*b*. The distal end 16 of the outer arm segment 14*b* is configured for the removable attachment of a hydraulically actuated implement thereto, e.g., a conventional backhoe-type bucket (not shown) or other device, depending upon the work to be accomplished by the excavator. In FIG. 1, the conventional implement has been removed from the distal end 16 of the outboard arm segment 14*b* and a mine and explosive clearing implement 18 installed thereto. The implement 18 is shown in an exemplary position of operation, its blades penetrating the surface S due to the weight of the outer excavator arm portion 14*b* and implement 18 as the implement 18 is dragged across the surface S by the arm assembly 14*a*, 14*b* of the excavator or prime mover 12.

Figure 2:
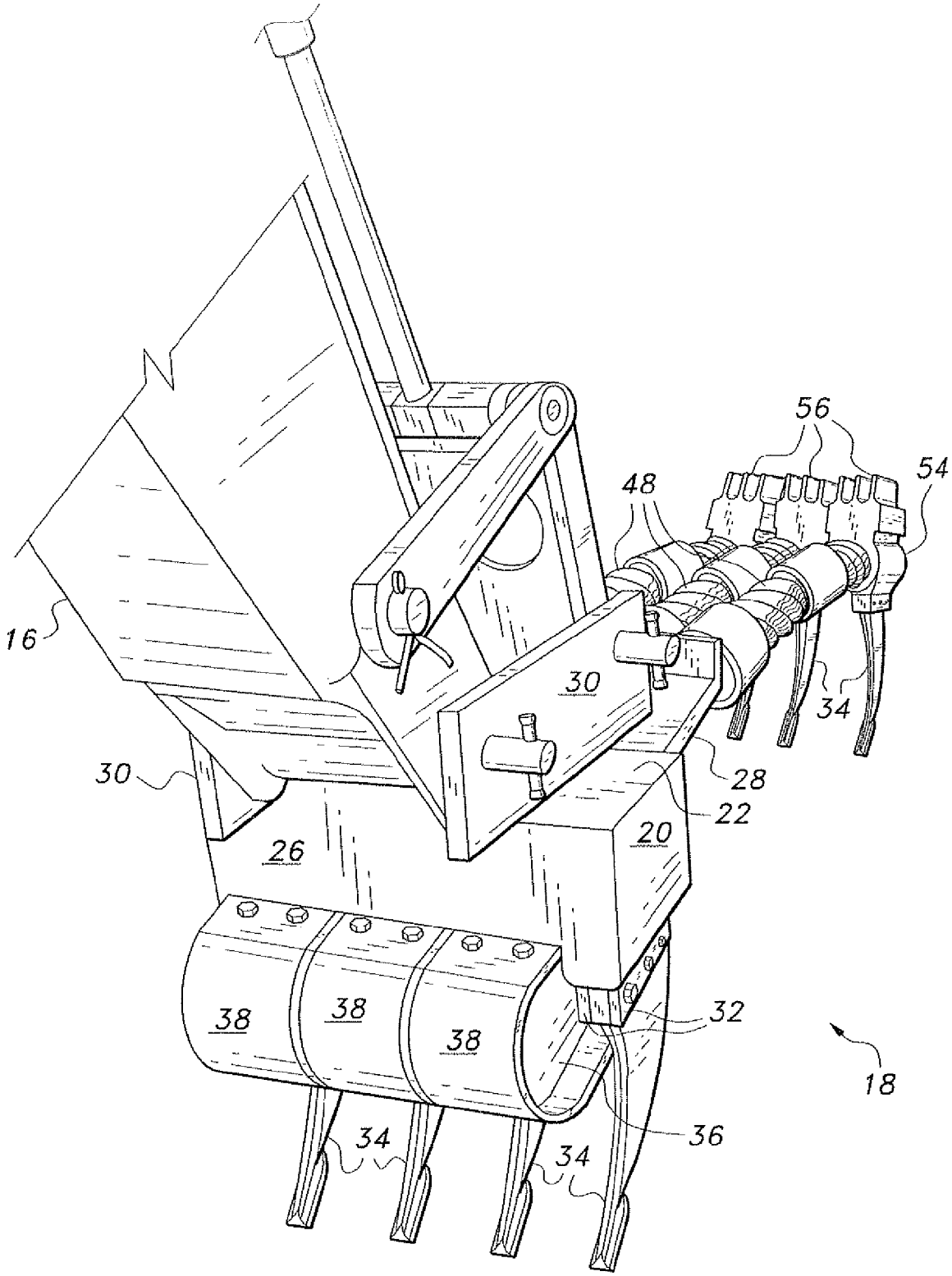
FIG. 2 is a partial perspective view of the mine and explosive clearing machine and implement of FIG. 1, showing details of the implement.
Figure 3:
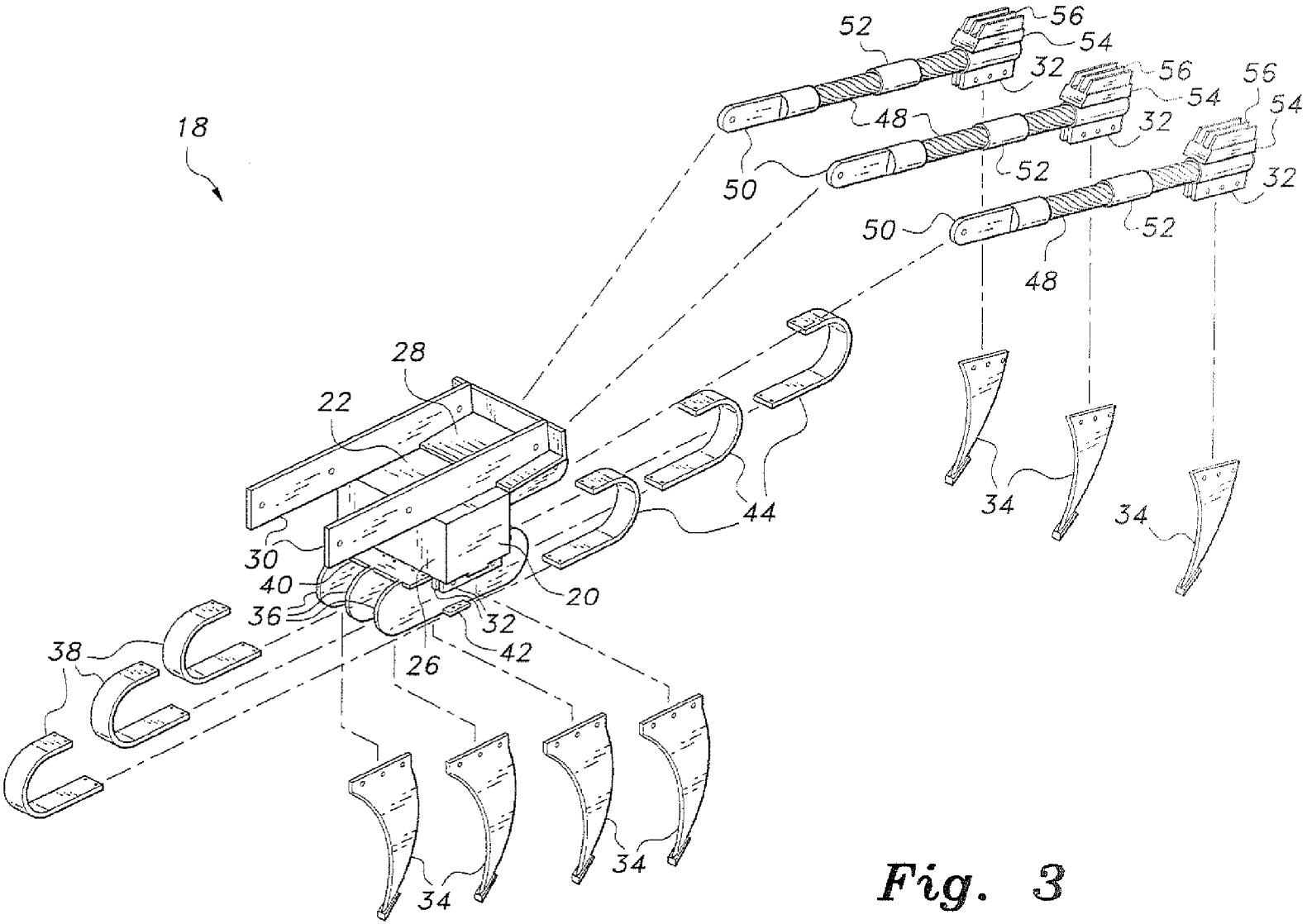
FIG. 3 is an exploded perspective view of the implement of the mine and explosive clearing machine and implement of FIG. 1, as seen from above the implement.
Figure 4A:
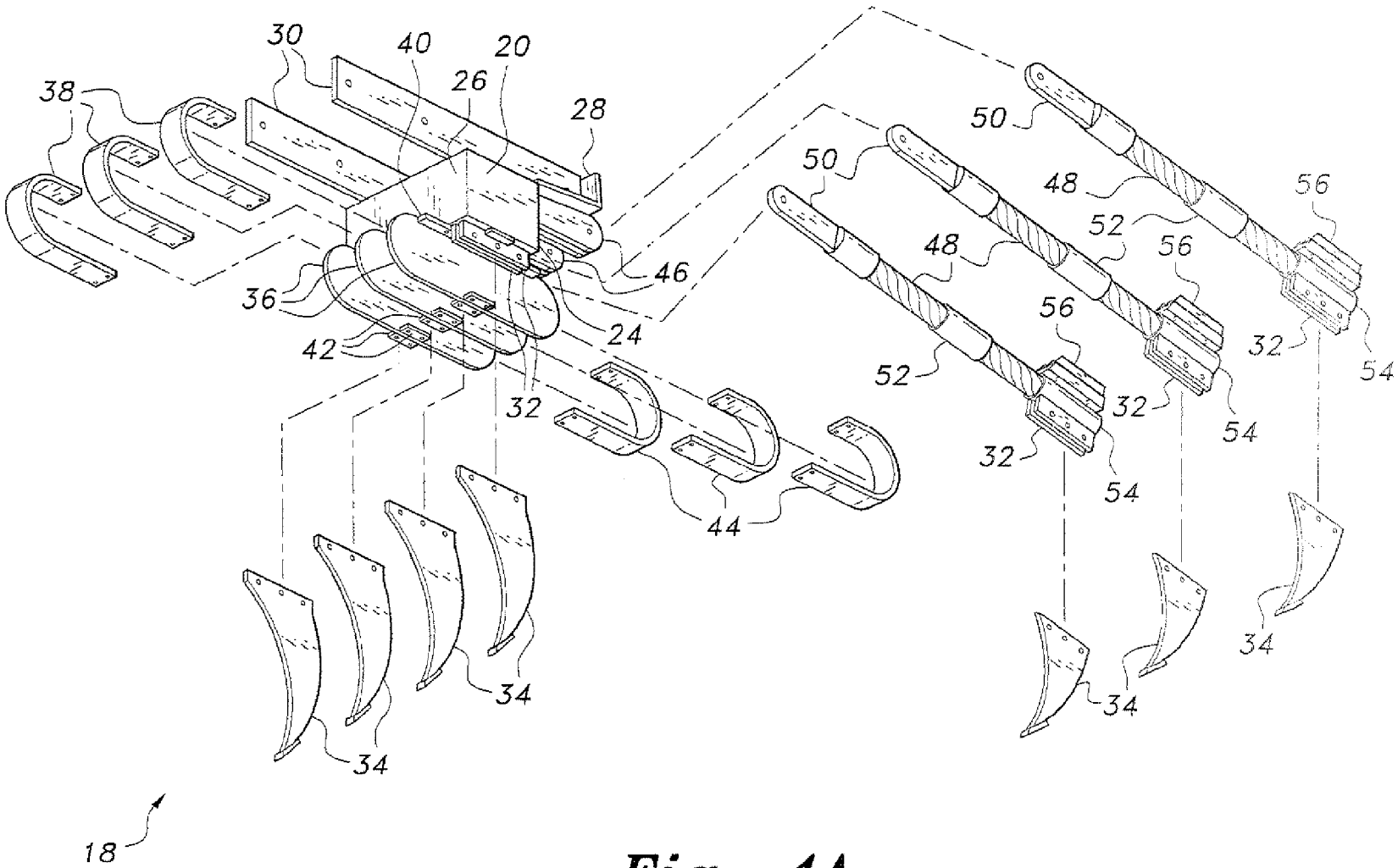
FIG. 4A is an exploded perspective view of the implement of the mine and explosive clearing machine and implement of FIG. 1, as seen from the bottom front of the implement.
Figure 4B:
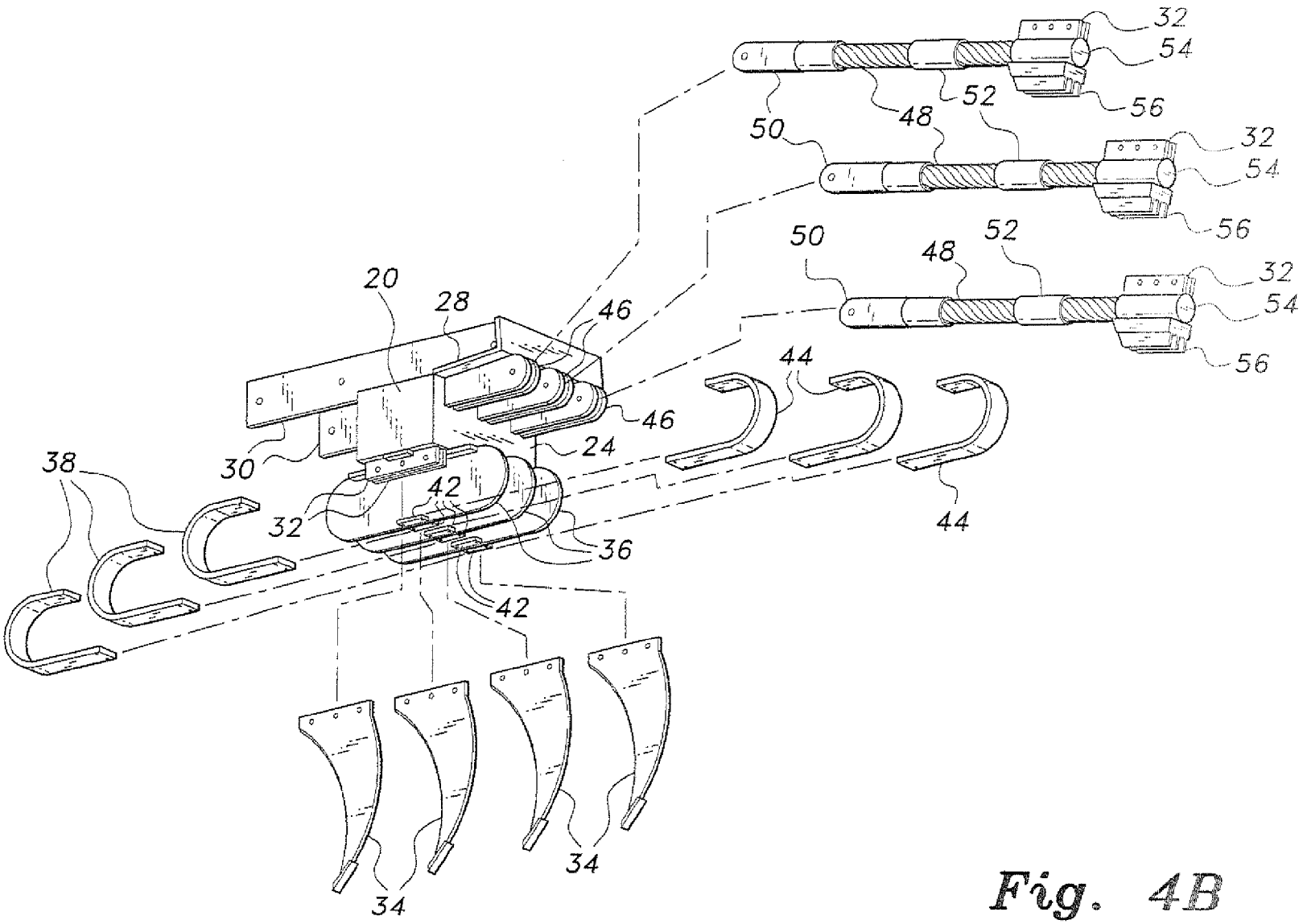
FIG. 4B is an exploded perspective view of the implement of the mine and explosive clearing machine and implement of FIG. 1, as seen from the bottom rear of the implement.

FIG. 2 of the drawings provides a perspective view of the implement 18 installed upon the distal end 16 of the excavator arm, as seen from front and left side. FIGS. 3, 4A, and 4B provide exploded perspective views of the implement 18 to illustrate the various components and their relationships. The implement 18 has a frame 20, shown more clearly in FIGS. 3, 4A, and 4B, which may be welded from heavy steel plate or otherwise constructed. The frame 20 has an upper portion 22, an opposite lower portion 24, a forward portion 26, and an opposite rear portion 28. A pair of prime mover arm attachment plates 30 are welded or otherwise securely attached to the upper portion 22 of the frame 20. These attachment plates 30 provide for the removable attachment of the implement 18 to the distal end 16 of the excavator arm 14 and its hydraulic linkage for implement articulation, generally as shown in FIGS. 1 and 2 of the drawings.

A plurality of blade attachment flanges 32 depend from the lower portion 24 of the implement frame 20, the flanges 32 being arranged in pairs. A tilling blade 34 is removably secured to each pair of blade attachment flanges 32, the upper edge of the blade 34 being captured between the two flanges 32 of each pair. A shoe support plate 36 extends from the lower portion 24 of the frame 20 between each pair of blade attachment flanges 32. The shoe support plates 36 brace a shoe portions or halves that are attached below the lower portion 24 of the implement frame 20, preventing the collapse of the shoe portions when weight is applied to the implement 18. Forward shoe halves 38 have upper ends that are secured to the forward edge 40 of the plate that defines the lower portion 24 of the implement frame 20, the lower ends of the forward shoe halves 38 being secured to medial attachment brackets 42 disposed upon the lower central edge of each of the shoe support plates 36. Similarly, rearward shoe halves 44 have their upper ends secured to the rearward edge of the plate forming the lower portion 34 of the frame 20, the lower ends of the rearward shoe halves 44 being attached to the attachment brackets 42 of the shoe support plates 36.

The shoe support plates 36, and thus the lower surfaces of the forward and rearward shoe halves 38 and 44, extend downward below the blade attachment flanges 32 and the upper portions of the blades 34. Thus, the remaining medial and lower portions of each tilling blade 34 extend below or beyond the shoe support plates 36 and the lower surfaces of their forward and rearward shoe halves 38, 44 to limit the penetration depth of the blades 34 into the underlying surface. The shoe halves 38 and 44 are preferably removably attached to their respective attachment points on the implement frame 20, e.g., by sturdy bolts, etc., to allow their replacement when they become worn or damaged. The attachment holes in the lower ends of the shoe halves 38 and 44 are preferably countersunk, and flathead bolts are used to secure the lower ends of the shoe halves 38, 44 to the attachment brackets 42 of the shoe support plates 36. In this manner, the surfaces of the heads of these bolts are flush with the outer or lower surfaces of the shoe halves 38 and 44 to preclude their catching on objects and being damaged or torn off during operation of the machine.

The rearward portion 28 of the implement frame 20 includes a rearward extending plate. A plurality of cable attachment bracket pairs 46 (some of which are shown in FIG. 4B) extend beneath the rearward plate and rearward from the rearward portion 28 of the frame 20. A corresponding plurality of heavy cables 48 have forward ends having lugs 50 extending therefrom, a lug 50 from each cable 48 being captured between the brackets of a corresponding one of the cable attachment bracket pairs 46. The lugs 50 are pinned in place through the attachment bracket pairs 46, e.g., by a bolt, pin, or other suitable device, to allow the cables 48 to swivel or swing in a fore and aft vertical plane. Thus, the cables 48 will hang vertically when the mine and explosive clearing implement 18 is lifted clear of the underlying surface by the articulating arm assembly 14*a*, 14*b* of the prime mover 12, but will drag on the surface behind the frame 20 and its attachments during operation of the device. Additional mass may be provided for the cables 48 by securing a weight collar 52 generally medially along each of the cables 48, if desired.

Each of the cables 48 has a distal end having a blade fitting 54 affixed thereon. Each blade fitting 54 includes a pair of blade attachment flanges 32 extending therefrom, the blade attachment flanges 32 of the implement frame 20 and of the blade fittings 54 being essentially identical to one another, as indicated by their common reference numerals. Each pair of blade attachment flanges 32 of the blade fittings 54 accepts the upper end of a tilling blade 34 therebetween in an arrangement similar to that used to secure identical tilling blades 34 to the blade attachment flanges 32 of the implement frame 20. All of the tilling blades 34 are identical to one another and may be interchangeably installed to either the attachment flanges 32 of the implement frame 20 or of the blade fittings 54. Each of the blade fittings 54 further includes a plurality of relatively short brush blades 56 extending therefrom, generally diametrically opposite the blade attachment flanges 32.

The removable attachment of each of the cables 48 to its cable attachment bracket pair 46 allows any or all of the cables to be removed and rotated axially through 180° to selectively orient either the blade attachment flanges 32 or the brush blades 56 downward, the opposite components extending upward. The operator of the machine 10 may adjust or reorient one or more of the cables 48 as desired, depending upon the type of terrain or surface being cleared. In FIG. 4A, the three cables 48 are shown with their blade attachment flanges oriented downward, thereby orienting the attached tilling blades 34 downward to dig into the underlying surface. In FIG. 4B the cables 48 are shown inverted from their orientation in FIG. 4A, i.e., the brush blades 56 are oriented downward in FIG. 4B to engage the underlying surface. The operator of the device may orient the cables and their blade attachment flanges 32, tilling blades 34, and brush blades 56 as shown in either FIG. 4A or FIG. 4B, depending upon the terrain to be swept.

Figure 5:
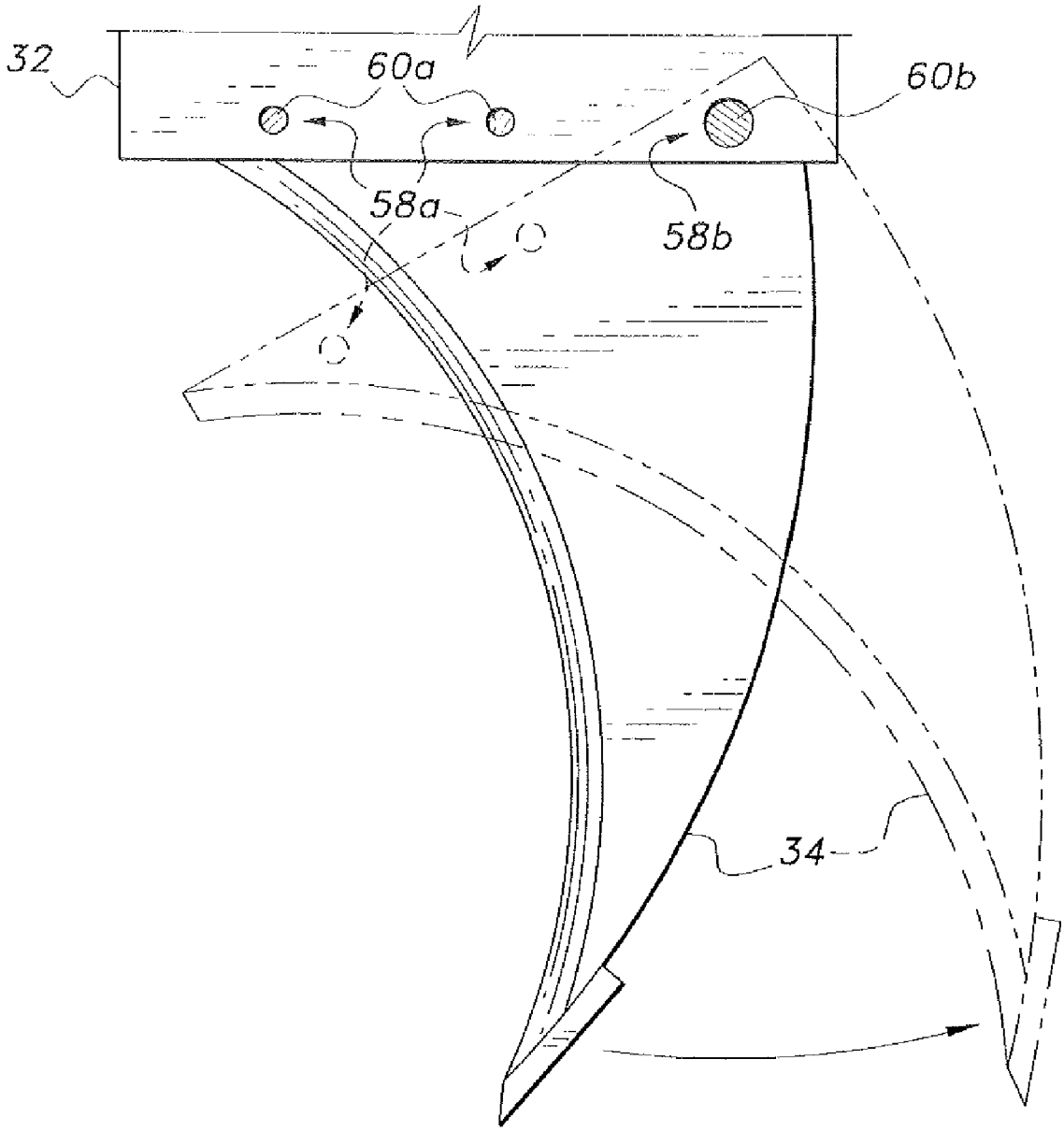
FIG. 5 is a left side elevation view of a single tilling blade of the mine and explosive clearing machine and implement of FIG. 1, showing its attachment to the frame structure and provision for pivoting breakaway of the blade when encountering a solid obstruction.

The mine and explosive clearing implement 18 also includes means for precluding, or at least reducing, damage to the tilling blades 34 in the event that one or more of the blades contacts an extremely hard object (e.g., large rock, concrete, etc.) during operation. FIG. 5 of the drawings provides an illustration of one means for providing such blade protection. It will be noted in FIG. 5 that the forward and medial areas of the blade attachment flanges 32 and the corresponding attachment area of the blade 34 have relatively smaller diameter first fastener passages 58*a* formed therethrough, while the rearmost second fastener passage 58*b* is of a larger diameter than the first fastener passages 58*a*. While there may be only a single first fastener passage 58*a*, preferably two such passages, including a forward passage and a medial passage, are provided. The smaller diameter first bolts or pins 60*a* installed through the first fastener passages 58*a* clearly cannot have the strength of the larger diameter second bolt or pin secured through the rearward second passage 58*b*. Thus, when the blade 34 hits a hard and immovable object, the weaker first bolts or pins 60*a* will shear, while the rearward second bolt or pin 60*b* retains its integrity. The blade 34 then swivels upward and rearward about the remaining larger diameter second bolt or pin 60*b*, as indicated by the position of the blade 34 shown in broken lines in FIG. 5.

It will be seen that there are other ways of accomplishing the provision of intentionally weaker forwardly disposed fasteners, e.g., first and second bolts or pins of equal diameter but having different hardnesses from one another, hollow core roll pins used for the first fasteners and solid core pins for the second fastener, etc. Any of these means may be chosen, so long as it permits the blade 34 to break away from the forwardly disposed first fastener(s) while swiveling upwardly and rearward about the remaining stronger second fastener.

It has been noted further above that the hydraulic system of the prime mover or long reach excavator 12 of the present invention is modified for use with the mine and explosive clearing implement 18 in order to allow the implement 18 to "float" over the surface as the arm is drawn forward toward the prime mover 12 during operation of the system. Conventionally, long reach excavators are equipped with two-way hydraulic valves to operate most of their hydraulic systems, including the lift strut 62 of the distal arm segment 14*b* (FIGS. 1 and 5). A schematic drawing of such a conventional system is shown in FIG. 6B of the drawings and labeled as prior art. In such a system, a hydraulic pump draws hydraulic fluid from a reservoir (both pump and reservoir are indicated collectively by the reference numeral 64) and supplies the fluid under pressure to the outer aim lift strut 62 through a control valve V. The conventional control valve V is a two-way valve, i.e., it may select a path for the hydraulic fluid to extend the hydraulic strut 62 or to retract the strut 62. There is no additional fluid flow path allowing the hydraulic fluid to flow directly from one end of the cylinder 62 to the other, i.e., to eliminate hydraulic pressure to one end or the other of the cylinder 62. This allows the operator to lift the outer or distal arm portion 14*b* above the underlying surface, or to drive the implement of the arm portion 14*b* into the underlying surface, as when such a long-reach excavator is being used with a backhoe-type implement or bucket.

Figure 6A:
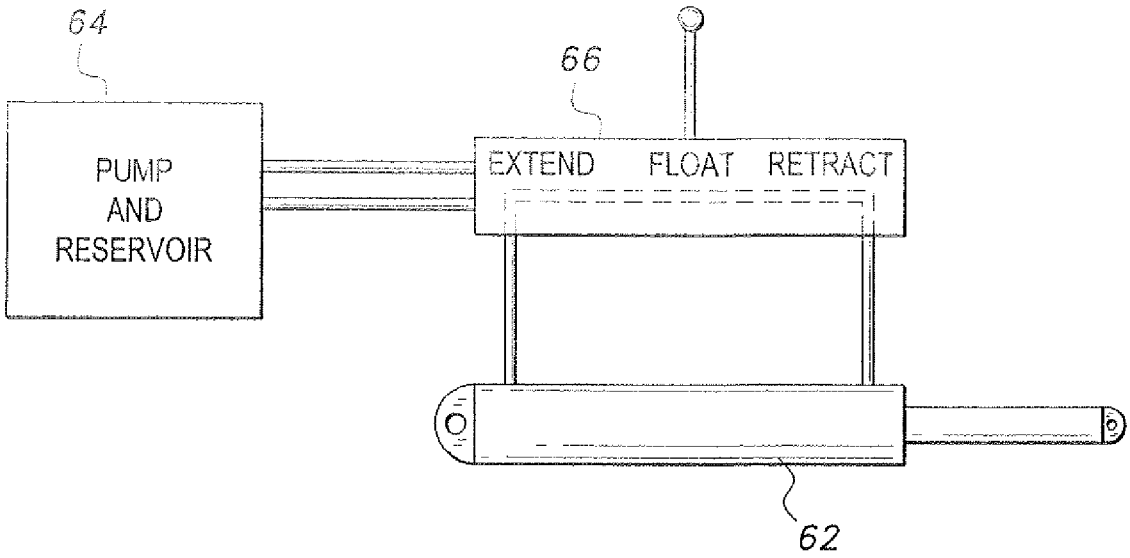
FIG. 6A is a simplified schematic drawing, showing the installation of a float valve in the hydraulic arm control of a long reach excavator of the mine and explosive clearing machine and implement of FIG. 1.
Figure 6B:
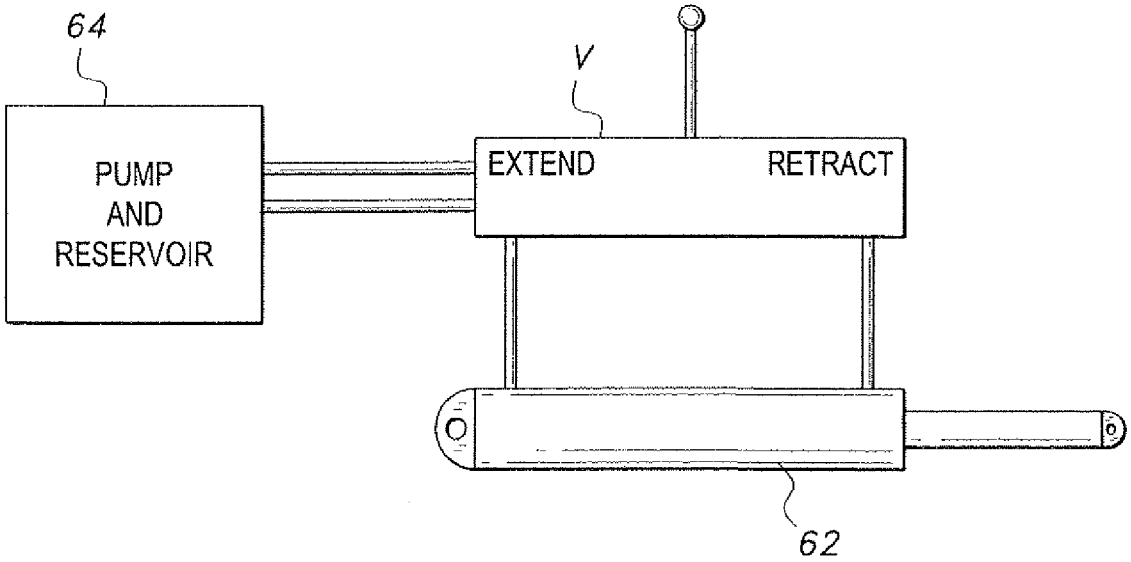
Fig. 6B PRIOR ART
FIG. 6B is simplified schematic drawing of a conventional hydraulic arm control for a long reach excavator of the prior art.

The prime mover or long reach excavator 12 of FIG. 1 is modified by removing the conventional two-way hydraulic control valve V controlling the articulation of the outer section 14*b* of the arm and installing a three-position "float" valve 66 in its place, generally as shown in FIG. 6A of the drawings. The float valve 66 includes a hydraulic passage directly connecting the two hydraulic ports or lines to the two ends of the hydraulic strut or cylinder. This passage is shown in broken lines within the valve 66 of FIG. 6A. Positioning the control to the "float" position shuts off hydraulic pressure and flow from the pump to the strut, and allows the fluid in the strut to flow freely from one end of the strut to the other in order to allow the outer arm segment 14*b* and implement 18 to "float" over the underlying surface. The tilling blades 34 engage the underlying surface due to the weight of the arm segment 14*b* and implement 18, or they may initially be driven into the surface S at the beginning of the operation by extending the strut 66.

The mine and explosive clearing operation is initiated by positioning the prime mover 12 at some distance from the area to be cleared. The arm assembly 14*a*, 14*b* is extended, and the distal end 16 of the arm is lowered to the surface. The blades 34 of the mine and explosive clearing implement may be driven into the underlying surface, if required, by maintaining positive pressure on the distal arm segment 14*b* until the blades 34 have penetrated the surface. The valve 66 may then be set to the "float" position to allow the distal portion 14*b* of the arm assembly to articulate freely as the implement 18 is drawn across the surface. The operator of the excavator 12 draws the proximal section 14*a* of the arm assembly upward, which pulls the distal section 14*b* of the arm assembly toward the prime mover 12 to draw the implement 18 across the surface. A conventional video camera 68, shown in FIG. 1, may be installed near the distal end 16 of the outer or distal arm segment 14*b* to transmit a detailed view of the terrain being encountered by the mine and explosive clearing implement 18 as it is pulled across the surface toward the prime mover 12.

In some instances it may be desirable to keep the blades 34 extending from the implement frame 20 from engaging the underlying surface. The multiple articulations provided by the conventional hydraulic control system of the excavator or prime mover 12 allow the implement 18 to be tilted so that its forwardly disposed portion, i.e., the forward shoe halves 38, are resting upon the surface, and the implement blades 34 are raised above the surface. The cables 48 may be oriented to orient the brush blades 56 downward so that the blades 34 extending from the blade fittings 54 on the distal ends of the cables 48 are oriented upward. This configuration may prove effective when clearing brushy or grassy areas and/or other vegetation, where the blades 34 might be clogged by such vegetation. Any mines or explosive devices would likely be buried relatively shallowly in such grassy or brushy areas, particularly in areas with relatively high grass or dense brush or the like.

The relatively narrow width of the mine and explosive clearing implement 18, and the narrow width of the arm segments 14*a* and 14*b*, enable the implement 18 to be positioned in relatively narrow alleyways and the like to clear antipersonnel mines, booby traps, an the like in areas that are too narrow for a conventional motor vehicle to pass. The articulation of the arm assembly 14*a*, 14*b* allows the implement 18 to be raised above the underlying surface and drawn through an area to catch any elevated trip wires or the like that may have been installed between buildings or structures along narrow streets or alleyways. The heavy cables 48 hang vertically below the implement frame 20 in this situation. If the implement 18 is moved away from the prime mover 12, the cables 48 will be the first component of the device to encounter any such trip wire, booby trap, or the like installed in the area, and will provide some shielding from the blast of such a device when it is detonated.

Another scenario in which the mine and explosive clearing machine and implement might be used is in clearing sandy soil. While the spacing of the blades 34 assures that they will encounter any larger anti-vehicle mines or the like that may be buried in such soil, smaller antipersonnel mines may pass between the blades as they are drawn through the soil. Accordingly, a heavy grid of material (e.g., concrete "rebar," chain link material, etc.) may be secured (welded, bolted, etc.) across the forward edges of the blades 34 installed upon the implement frame 18 and/or the cables 48. Such a grid will allow loose, sandy soil to pass therethrough while capturing and likely detonating smaller antipersonnel mines and devices. Other structure for capturing such smaller explosive devices may be provided alternatively as desired, e.g., a series of small blades (approximately one inch, more or less) or the like extending laterally from each of the larger blades 34. Moreover, while the frame 20 illustrated in the various drawings provides for the attachment of four laterally spaced tilling blades and three trailing cables, it will be seen that the frame may be widened or narrowed to accommodate more or fewer blades and cables, depending upon the needs of the operator. Accordingly, the versatility and safety provided by the mine and explosive clearing machine and implement in numerous widely varying environments provides a substantial improvement over conventional devices adapted to perform such tasks.

It is to be understood that the present invention is not limited to the embodiments described above, but encompasses any and all embodiments within the scope of the following claims.

I claim:

1. A mine and explosive clearing machine and implement, comprising:

a prime mover;

an elongate, articulating arm selectively extending from the prime mover, the arm having a distal end;

a hydraulic system selectively controlling vertical motion of the arm;

a hydraulic float valve incorporated within the hydraulic system; and a mine and explosive clearing implement removably attached to the distal end of the arm;

wherein the mine and explosive clearing implement further comprises:

a frame having an upper portion, a lower portion opposite the upper portion, a forward portion, and a rear portion opposite the forward portion;

a pair of prime mover arm attachment plates disposed upon the upper portion of the frame;

a plurality of blade attachment flange pairs disposed upon the lower portion of the frame;

a tilling blade removably attached to each of the blade attachment flange pairs;

a plurality of cable attachment bracket pairs extending from the rear portion of the frame; and a cable removably and pivotally attached to each of the cable attachment bracket pairs.

2. The mine and explosive clearing machine and implement according to claim 1, further comprising a shoe support plate depending from the lower portion of the frame of the implement between each of the blade attachment flange pairs, each of the shoe support plates having:

a forward shoe half removably attached to the shoe support plate and to the forward portion of the frame of the implement; and a rear shoe half removably attached to the shoe support plate and to the rear portion of the frame of the implement.

3. The mine and explosive clearing machine and implement according to claim 1, wherein the mine and explosive clearing implement further comprises a blade fitting disposed upon a distal end of each said cable, each of the blade fittings having a plurality of brush blades extending therefrom and a corresponding one of said blade attachment flange pairs extending therefrom diametrically opposite the brush blades, the corresponding one of said blade attachment flange pairs having a corresponding one of said a tilling blades removably attached thereto.

4. The mine and explosive clearing machine and implement according to claim 3, wherein each said cable has a first selectively installed orientation in which the brush blades of the blade fitting are oriented upwardly and the blade attachment flange pair of the blade fitting is oriented downwardly, and a second selectively installed orientation in which the brush blades of the blade fitting are oriented downwardly and the blade attachment flange pair of the blade fitting is oriented upwardly.

5. The mine and explosive clearing machine and implement according to claim 3, wherein each said tilling blade is substantially identical, each said tilling blade being interchangeably attached to any of the blade attachment flange pairs of the lower portion of the frame and to the blade attachment flange pair of the blade fitting of any cable.

6. The mine and explosive clearing machine and implement according to claim 3, wherein each said tilling blade, each of the blade attachment flange pairs of the lower portion of the frame, and the blade attachment flange pair of the blade fitting of each said cable include at least one first fastener passage extending therethrough and a single second fastener passage extending therethrough, the second fastener passage being behind the first fastener passage, the mine and explosive clearing machine and implement further comprising:

a first fastener selectively installed through each of the first fastener passages to secure each said tilling blade to a corresponding one of the blade attachment flange pairs; and a second fastener disposed through each of the second fastener passages to secure each said tilling blade to a corresponding one of the blade attachment flange pairs, the second fastener having a greater strength than the first fastener.

7. A mine and explosive clearing implement adapted for attachment to an excavator, the excavator having an articulated arm selectively extendable therefrom, the implement comprising:

a frame having an upper portion, a lower portion opposite the upper portion, a forward portion, and a rear portion opposite the forward portion;

a pair of prime mover arm attachment plates disposed upon the upper portion of the frame, the attachment pates being adapted for attaching the implement to the excavator arm;

a plurality of blade attachment flange pairs disposed upon the lower portion of the frame;

a tilling blade removably attached to each of the blade attachment flange pairs;

a plurality of cable attachment bracket pairs extending from the rear portion of the frame; and a cable removably and pivotally attached to each of the cable attachment bracket pairs.

8. The mine and explosive clearing machine and implement according to claim 7, wherein the excavator has a hydraulic system selectively controlling vertical motion of the arm; the implement further comprising a hydraulic float valve adapted for incorporation into the hydraulic system, the float valve having a user-selectable position permitting the arm to drag said frame along the ground with the arm freely articulating when said tilling blades encounter resistance in the ground.

9. The mine and explosive clearing machine and implement according to claim 7, further comprising a shoe support plate depending from the lower portion of the frame of the implement between each of the blade attachment flange pairs, each of the shoe support plates having:

a forward shoe half removably attached to the shoe support plate and to the forward portion of the frame of the implement; and a rear shoe half removably attached to the shoe support plate and to the rear portion of the frame of the implement.

10. The mine and explosive clearing machine and implement according to claim 7, further comprises a blade fitting disposed upon a distal end of each said cable, each of the blade fittings having a plurality of brush blades extending therefrom and a corresponding one of said blade attachment flange pairs extending therefrom diametrically opposite the brush blades, the corresponding one of said blade attachment flange pairs having a corresponding one of said a tilling blades removably attached thereto.

11. The mine and explosive clearing machine and implement according to claim 10, wherein each said cable of the implement has a first selectively installed orientation in which the brush blades of the blade fitting are oriented upwardly and the blade attachment flange pair of the blade fitting is oriented downwardly, and a second selectively installed orientation in which the brush blades of the blade fitting are oriented downwardly and the blade attachment flange pair of the blade fitting is oriented upwardly.

12. The mine and explosive clearing machine and implement according to claim 10, wherein each said tilling blade of the implement is substantially, said tilling blades being interchangeably attached to any of the blade attachment flange pairs of the lower portion of the frame of the implement and to the blade attachment flange pair of the blade fitting of any said cable of the implement.

13. The mine and explosive clearing machine and implement according to claim 10, wherein each said tilling blade, each of the blade attachment flange pairs of the lower portion of the frame, and the blade attachment flange pair of the blade fitting of each said cable include at least one first fastener passage extending therethrough and a single second fastener passage extending therethrough, the second fastener passage being behind the first fastener passage, the mine and explosive clearing machine and implement further comprising:

a first fastener selectively installed through each of the first fastener passages to secure each said tilling blade to a corresponding one of the blade attachment flange pairs; and a second fastener disposed through each of the second fastener passages to secure each said tilling blade to a corresponding one of the blade attachment flange pairs, the second fastener having a greater strength than the first fastener.

14. A mine and explosive clearing machine and implement, comprising:

a machine having an articulated arm selectively extendable therefrom; and a mine and explosive clearing implement attached to the arm, the implement having;

a frame having an upper portion, a lower portion opposite the upper portion, a forward portion, and a rear portion opposite the forward portion;

a pair of prime mover arm attachment plates disposed upon the upper portion of the frame for attaching the implement to the arm;

a plurality of blade attachment flange pairs disposed upon the lower portion of the frame;

a plurality of cable attachment bracket pairs extending from the rear portion of the frame;

a cable removably and pivotally attached to each of the cable attachment bracket pairs, each of the cables having a distal end;

a blade fitting disposed upon the distal end of each of the cables, each of the blade fittings having a plurality of brush blades extending therefrom and a blade attachment flange pair extending therefrom diametrically opposite the brush blades; and a tilling blade removably attached to each of the blade attachment flange pairs of the frame and to the blade attachment flange pair of the blade fitting of each of the cables.

15. The mine and explosive clearing machine and implement according to claim 14, further comprising:

a hydraulic system selectively controlling vertical motion of the arm of the machine; and a hydraulic float valve incorporated within the hydraulic system, the float valve having a user-selectable position permitting the arm to drag said frame along the ground with the arm freely articulating when said tilling blades encounter resistance in the ground.

16. The mine and explosive clearing machine and implement according to claim 14, further comprising a shoe support plate depending from the lower portion of the frame of the implement between each of the blade attachment flange pairs, each of the shoe support plates having:

a forward shoe half removably attached to the shoe support plate and to the forward portion of the frame of the implement; and a rear shoe half removably attached to the shoe support plate and to the rear portion of the frame of the implement.

17. The mine and explosive clearing machine and implement according to claim 14, wherein each cable of the implement has a first selectively installed orientation in which the brush blades of the blade fitting are oriented upwardly and the blade attachment flange pair of the blade fitting is oriented downwardly, and a second selectively installed orientation in which the brush blades of the blade fitting are oriented downwardly and the blade attachment flange pair of the blade fitting is oriented upwardly.

18. The mine and explosive clearing machine and implement according to claim 14 wherein each said tilling blade of the implement is substantially identical, said tilling blades being interchangeably attached to any of the blade attachment flange pairs of the lower portion of the frame of the implement and to the blade attachment flange pair of the blade fitting of any said cable of the implement.

19. The mine and explosive clearing machine and implement according to claim 14, wherein each said tilling blade, each of the blade attachment flange pairs of the lower portion of the frame, and the blade attachment flange pair of the blade fitting of each said cable include at least one first fastener passage extending therethrough and a single second fastener passage extending therethrough, the second fastener passage being behind the first fastener passage, the mine and explosive clearing machine and implement further comprising:

a first fastener selectively installed through each of the first fastener passages to secure each said tilling blade to a corresponding one of the blade attachment flange pairs; and a second fastener disposed through each of the second fastener passages to secure each said tilling blade to a corresponding one of the blade attachment flange pairs, the second fastener having a greater strength than the first fastener.

* * * * *